US006239087B1

(12) United States Patent
Mao et al.

(10) Patent No.: US 6,239,087 B1
(45) Date of Patent: May 29, 2001

(54) DETERGENT COMPOSITIONS CONTAINING FRAGRANCE PRECURSORS AND THE FRAGRANCE PRECURSORS THEMSELVES

(75) Inventors: Hsiang Kuen Mao, Kobe (JP); Joseph Paul Morelli; Henry Cheng Na, both of Cincinnati, OH (US); Robert Ya-Lin Pan, Kobe (JP); Mark Robert Sivik, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/155,140

(22) PCT Filed: Mar. 22, 1996

(86) PCT No.: PCT/US96/04060

§ 371 Date: Sep. 22, 1998

§ 102(e) Date: Sep. 22, 1998

(87) PCT Pub. No.: WO97/34986

PCT Pub. Date: Sep. 25, 1997

(51) Int. Cl.[7] ..... C11D 3/20; C11D 3/26; C11D 3/50

(52) U.S. Cl. ..... 510/101; 510/102; 510/103; 510/104; 510/105; 510/106; 510/336; 510/340; 510/345; 510/346; 510/349; 510/352; 8/137; 512/2

(58) Field of Search ..... 510/101, 102, 510/103, 104, 105, 106, 336, 340, 349, 445, 446, 452; 8/137; 512/2

(56) References Cited

U.S. PATENT DOCUMENTS

| | | | | |
|---|---|---|---|---|
| 2,448,660 | | 9/1948 | Croxall et al. | 568/600 |
| 2,490,337 | | 12/1949 | Croxall et al. | 568/594 |
| 5,288,423 | * | 2/1994 | Behan et al. | 252/174.11 |
| 5,447,644 | * | 9/1995 | Guenin et al. | 252/8.6 |
| 5,500,138 | | 3/1996 | Bacon et al. | 510/102 |
| 5,500,154 | | 3/1996 | Bacon et al. | 510/102 |
| 5,656,584 | * | 8/1997 | Angell et al. | 510/441 |
| 5,668,862 | | 9/1997 | Price et al. | 568/594 |
| 5,731,282 | * | 3/1998 | Duquesne | 510/423 |

OTHER PUBLICATIONS

Rothman et al., "Enol Esters XVI: Enol Ethers in Synthesis": Eastern Regional Research Laboratory, Philadelphia, Pennsyvania, pp. 376–377, (Jun. 1972).

Dejarlais et al., "Preparation of Some Ethyl Higher–Alkyl Acetals and Their Conversion to Vinyl Ethers": Northern Regional Research Laboratory, Peoria, Illinois, pp. 241–243, (May 1961).

* cited by examiner

*Primary Examiner*—Gregory DelCotto
(74) *Attorney, Agent, or Firm*—R. S. Echler, Sr.; K. W. Zerby; S. W. Miller

(57) ABSTRACT

Detergent compositions containing certain acetals or ketals which hydrolyze upon exposure of surfaces washed in solution of said compositions to a reduction in pH, thereby releasing a fragrance which is characteristic of one or more of the hydrolysis products. The acetals and ketals themselves also form part of the invention; they have a molecular weight of at least about 350; a ClogP of about 4, and a half-life of less than 60 minutes when measured at pH=0 by the pro-fragrant hydrolysis test.

6 Claims, No Drawings

DETERGENT COMPOSITIONS CONTAINING FRAGRANCE PRECURSORS AND THE FRAGRANCE PRECURSORS THEMSELVES

FIELD OF THE INVENTION

The present invention relates to detergent compositions containing mal or ketal pro-fragrace compounds and methods for accomplishing the delivery of such organic pro-fragrace compounds to textile articles and other surfaces washed with said compositions, and in certain preferred pro-fragrance componds which are believed to be novel. More particularly, the invention relat to laundry detergent compositions in which there is a delayed release of fragraces from surfaces washed in an aqueous bath in the prescnce of conventional detergent ingredients. The fragrace is released in fragrace-active form when the surface is in contact with a lower pH environment such as contact with water, carbon dioxide gas, humid air, or the like.

BACKGROUND OF THE INVENTION

Most consumers have come to expect scented laundry products and to expect that fabrics which have been laundered to also have a pleasing fragrance. It is also desired by consumers for laundered fabric to maintain the pleasing fragrance over time. Perfume additives make laundry compositions more aesthetically pleasing to the consumer, and in some cases the perfume imparts a pleasant fragrace to fabrics treated therewith. However, the amount of perfume carry-over from an aqueous laundry bath onto fabrics is often marginal and does not last long on the fabric. In addition, some perfum delivery systems are not stable under alkaline conditions, such as in laundry detergent compositions. Fragrance materials are often very costly and their inefficient use in detergents and ineffective delivery to fabrics from detergents results in a very high cost to both consumers and detergent manufacturers. Industry, therefore, continues to seek with urgency for more efficient and effective fragrance delivery in laundry products, especially for improvement in the provision of long-lasting fragrance to the lundered fabrics.

Acetals and ketals have long been known in perfumery. See Steffen Arctander, "Perfume and Flavor Chemicals", Arctander, N. J., 1969. The majority of these are methyl and ethyl types, and molecular weights may range widely. See, for example, Arctander abstract numbers 6, 11, 210, 651, 689, 1697, 1702, 2480, 2478. For 2478, which is phenylacetaldehyde dicitronellyl acetal, molecular weight 414.7, Arctander reports " . . . and it is not exaggerated to say that this acetal is practically abandoned and obsolete in today's perfumery". For 2480, which is phenylacetaldehyde digeranyl acetal, Arctander reports "the title material does not offer substantial advantages or unique odor type and it may be considered of little more than academic interest today". This latter material was still commercially available in 1992 as ROSETAL A (Catalogue, IFF). The present inventors have found indeed that the acetals of aldehydes which have low molecular weight and contain a $C_6H_5$ moiety, such as benzaldehyde and phenylacetaldehyde, do not have very desirable odor character for use in a pro-fragrancing detergent mode. Yet another group of commercial acetals sold for incorporation in perfumes are those of undecylenic aldehyde, such as the digeranyl or dicitronellyl acetals. The present inventors have found that these materials too are not very desirable for use in profragrancing detergent compositions.

Carrier mechanisms for perfume delivery, such as by encapsulation, have been taught in the prior art. See for example, U.S. Pat. No. 5,188,753.

Early efforts to delay release of perfumes in detergents include the use of certain organometallic compounds, such as titanate or zirconate esters. See U.S. Pat. No. 3,849,326, Jaggers et al, issued Nov. 19, 1974 and U.S. Pat. No. 3,923,700, Jaggers et al, issued Dec. 2, 1975. Limited amounts of titanium or zirconium can be useful as catalysts for synthesizing pro-fragrant materials herein, and may be present in minor amounts in comparison to the present invention; however, organometallic titanium or zirconium compounds, or the metals per se, are not essential components of the pro-fragrant materials herein.

U.S. Pat. No. 5,378,468, Suffis et al, issued Jan. 3, 1995 describes specific types of personal care compositions, such as deodorant sticks, comprising assertedly "body-activated" fragrances. The term apparently refers to the previously known tendency of materials such as acetals derived from fragrance alcohols to hydrolyze under acidic pH conditions thereby releasing fragrance. See, for example, U.S. Pat. No. 3,932,520, Hoffman, issued Jan. 13, 1976.

Factors affecting substantivity of fragrance materials on fabrics are discussed in Estcher et al. JAOCS 71 p. 31–40 (1994).

The selected potential fragrance materials described by Suffis et al include particular acetals and ketals, exemplified by propylene glycol vanillin acetal. The materials exemplified apparently are rather bydrophilic short chain alcohol or diol derivatives of fragrance aldehydes and upon hydrolysis, deliver one mole of the aldehyde per mole of the potential fragrance material. The present inventors believe that hydrophilic acetal or ketal materials, i.e., those having a CLogP value (described hereafter) of less than 4 have at best limited usefulness in laundry detergent compositions. The Suffis et al development is designed to be incorporated with a personal care product vehicle, resulting in clear deodorant sticks and the like.

For detergent use, it is important that rather hydrophobic pro-fragrant compounds be used in order to enhance deposition onto surfaces in the wash solution and retention on the washed surface during rinsing. In Suffis et al, the compositions containing the potential fragrance materials are applied directly to the substrate (i.e. skin); therefore, the deposition problems resulting from dilution, rinsing, etc. are not at issue.

More specifically, in contrast to deodorant sticks and the like, laundry detergents are used in dilute aqueous form and contain numerous detergent adjuncts such as synthetic detergents, builders, enzymes and the like which are capable of micellizing, or solubilizing the pro-fragrance. Further, in order to remove detergent adjuncts and the soils displaced by detergent adjuncts from the fabrics, the latter are rinsed after washing. The rinsing tends to remove the useful pro-fragrance material deposited. Thus both the detergent adjuncts and the essential steps of the wash process itself all work against the effective delivery of pro-fragrances to the fabrics being washed. Moreover, high-efficiency pro-fragrant systems are desired for laundry purposes. In many laundry applications, the use of heated tumble-drying appliances further exacerbates the problem of delivering adequate residual fragrance to textile fabric surfaces. Suffis et al are silent on both the nature of these severe technical problems and shortcomings, as well as methods and specific pro-fragrances to overcome them.

It has now surprisingly been discovered that these problems can unexpectedly be overcome by the selection of specific organic pro-fragrance types. Moreover, when these pro-fragrance types are selected, a simple but effective method is successfully provided for their effective delivery. Accordingly, objects of the present invention include the provision of such pro-fragrance types and the corresponding detergent compositions and methods. While the present invention is primarily directed to the laundering of fabrics, the compositions of the present invention are also useful in the washing of other surfaces (e.g. hard surfaces such as floors, walls, and dishes) when it is desired to impart residual fragrances to the washed surface.

By the term "pro-fragrance" herein, it is meant a compound which may or may not be odoriferous in itself but which, upon hydrolysis, produces a desirable odor which is characteristic of one or more of its hydrolysis products. Of course. mixtures of pro-fragrance compounds can also be considered a pro-fragrance.

SUMMARY OF THE INVENTION

The present invention relates to a detergent composition for imparting residual fragrance to surfaces washed with aqueous solutions of said detergent, said detergent comprising:

(a) a pro-fragrant compound selected from the group consisting of acetals, ketals, and mixtures thereof, wherein at least one of the parent aldehydes, ketones, or alcohols of said pro-fragrant acetal or ketal is a fragrance compound, said pro-fragrant compound having;
  (i) a molecular weight of at least about 350,
  (ii) a CLogP of at least about 4, preferably about 6 or higher, more preferably about 10 or higher, wherein CLogP is the logarithm to base 10 of the octanol/water partition coefficient of said pro-fragrant compound, and
  (iii) a half-life of less than 60 minutes, when measured at pH 0 by the Pro-Fragrant Hydrolysis Test; and (b) a detersive surfactant;

wherein said detergent composition has a pH of at least 7.1, generally in the range 7.1 to 13, more typically in the range from about 7.5 to about 12, as indicated in detail hereinafter.

The present invention also relates to a method of delivering residual fragrances to a washed surface.

All percentages, ratios, and proportions herein are on a weight basis unless otherwise indicated. All documents cited are hereby incorporated by reference.

DETAILED DESCRIPTION OF THE INVENTION

Pro-fragrances

The pro-fragrances of this invention are acetals, ketals, or mixtures thereof, provided that compounds from which they are formed comprise at least one fragrance compound. Acetals and ketals may in general be considered as derivable from aldehydes or ketones in combination with alcohols. These aldehydes, ketones and alcohols are herein termed "parents" or "parent compounds" of the acetal or ketal. At least one parent of any of the instant acetals or ketals is a fragrance compound. Additionally any pro-fragrance compound of the inventive compositions has the following properties:

(i) molecular weight of at least about 350,
(ii) CLogP of at least about 4, (preferably at least 6, more preferably at least 10) wherein CLogP is the logarithm to base 10 of the octanol/water partition coefficient of said pro-fragrant compound, and
(iii) a half-life of less than 60 mninutes, when measured at pH 0 by the Pro-Fragrant Hydrolysis Test.

These pro-fragrance compounds are stable under pH conditions encountered in the formulation and storage of detergent products which have a pH of from about 7.1 to 13, and during solution-use of such products. Due to their high molecular weight and hydrophobicity, these pro-fragrance compounds give reasonably good deposition from a laundering solution onto fabrics. Because the pro-fragrant compounds are subject to hydrolysis when the pH is reduced, they hydrolyze to release their component fragrance compounds when the fabrics upon which they have been deposited are exposed even to reduced pH such as present in rinse water, air and humidity. The reduction in pH should be at least 0.1, preferably at least about 0.5 units. Preferaby the pH is reduced by at least 0.5 units to a pH of 7.5 or less, more preferably 6.9 or less. Preferably, the solution in which the fabric (or other surface) is washed is alkaline.

An important class of preferred acetals herein are those derived from parent aldehydes other than those which possess both of the following characteristics: (a) low molecular weight and (b) contain a $C_6H_5$ moiety which has no substituent groups other than the aldehyde itself. Such relatively undesirable acetals for the present purposes are those derived from benzaldehyde and phenylacetaldehyde. More preferably, acetals herein, when they comprise an aromatic moiety, will be derived from a parent aldehyde having molecular weight above about 125, more preferably above about 140.

Another important class of preferred acetals herein are are those derived from a fragrant $C_9$- or higher unsaturated aldehyde and a fragrant or non-fragrant alcohol particularly the $C_6$–$C_{20}$ (preferably $C_{11}$–$C_{20}$, more preferably $C_{14-C18}$) saturated or unsaturated, linear or branched aliphatic alcohols, commonly referred to as detergent alcohols. Optionally said alcohols can be alkoxylated with 1 to 30 moles of ethylene oxide propylene oxide or mixtures thereof. Preferred alcohols in the above group are illustrated by OXO alcohols and Guerbet alcohols. Aromatic or aliphatic alcohols can be used.

Alternately, though less desirably, other hydrophobic non-fragrant alcohols may be substituted for the above-identified alcohols while remaining within the spirit and scope of the invention.

More generally, a wide range of acetals and ketals are included within the invention. As noted above, the acetals and ketals are derived from an aldehyde or ketone and an alcohol, at least one of which is a fragrance compound. Many fragrant aldehydes, ketones, and alcohols which are suitable parent compounds for the present acetals and ketals are known to the art. See, for example, Arctander's compilation referenced hereinabove for fragrant parent compounds. Specific fragrant parent aldehydes include but are not limited by the following examples: bydratropaldehyde, p-t-bucinal, Floralozone™, cyclamal, triplal, helional, hexylcinnamic aldehyde, vanillin, citral, citroneUal, dodecanal, decanal, hydroxycitronellal, and octanal. Alternately, the aldehyde can be non-fragrant. Nonfragrant aldehydes include 1,4-terephthalyl dicarboxaldehyde or other aldehydes having low volatility by virtue of incorporation of bulky polar moieties.

Specific parent alcohols of fragrant types suitable herein are likewise given in Arctander and include but are not limited by phenylethyl alcohol, geraniol, nerol, citronellol, linalool, tetrahydrolinalool, dihydromyrcenol. dimethylcarbitol, 9-decen-1-ol, phenylpropyl alcohol, phenylhexylalcohol (phenoxanol or 3-methyl-5-phenyl pentanol), ocimenol, patchone, and 2-(5,6,6-trimethyl-2-norbornyl) cyclohexanol. Other parent alcohols which can be used include ethanol, propanol, butanol, lauryl alcohol, myristyl alcohol, and 2-ethylhexanol; parent alcohols having very low odor or alcohols which are essentially non-fragrant, include stearyl and behenyl alcohols. As noted supra, a preferred group of alcohols includes the detergent alcohols and their alkoxylates.

Ketones herein may likewise vary in wide ranges. Suitable fragrant ketone parent compounds for the instant acetals and ketals include benzylacetone, methyl dihydrojasmonate, methyl amyl ketone, methyl nonyl ketone, carvone, geranylacetone, alpha-ionone, beta-ionone, gamma-methyl ionone, damascenone, cis-jasmone, methyl-beta-naphthyl ketone. Other suitable ketones include diketones, e.g. 2,4-pentadione.

Many other suitable parent alcohols, aldehydes and ketones are obtainable commercially from perfume houses such as IFF, Firmenich, Takasago, H&R, Givaudan-Roure, Dragoco, Aldrich, Quest, and others.

Acetals suitable in the present invention have the following structure:

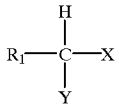

Such acetals can be used to deliver fragrance aldehydes, fragrance alcohols, or both. $R_1$ and the H are derived from a starting aldehyde. The parent aldehyde is a fragrant aldehyde when no alcohol parent is fragrant, or can be a fragrant or non-fragrant aldehyde when a fragrant alcohol has been incorporated into the acetal structure. Preferred acetals include those in which $R_1$ comprises a $C_8$ or larger alkyl or alkenyl moiety. In addition, the non-fragrant aldehyde can contain one or more aldehyde functional groups for derivatization, in which case the acetal can be either monomeric or polymeric. Although polymeric structures are operable, preferred acetals herein are mono-acetals and di-acetals, most preferably monoacetals. The present compositions can optionally include hemiacetals, but hemiacetals are by definition not acetals herein and can not be used as the essential pro-fragrant component.

In general, both fragrant and non-fragrant aldehydes incorporated into the instant acetals can be aliphatic, allylic or benzylic. The aldehydes can be saturated, unsaturated, linear, branched, or cyclic. The structures can include alkyl, alkenyl, or aryl moieties, as well as additional functional groups such as alcohols, amines, amides, esters, or ethers.

X and Y in the above general structure represent independently variable alkoxy moieties derived from alcohols that can be either fragrant alcohols or non-fragrant alcohols, provided that when no fragrant aldehyde is incorporated into the acetal, at least one fragrant alcohol is incorporated. X and Y can be the same or different allowing the delivery of more than one type of fragrant alcohol. When the alcohols are non-fragrant alcohols, it is preferred that they are $C_6$–$C_{20}$ alcohols, especially fatty alcohols, which may optionally be modified by ethoxylation, propoxylation or butoxylation. X and Y can be simple alcohols containing a single OH group, or can be polyols containing 2 or more OH groups, more preferably, diols. Preferred polyols useful as parent alcohols for making acetals or ketals herein which are especially useful in heavy-duty laundry granules include those which are not able to form 5 or 6 membered cyclic acetals or ketals, such as 1,4-dimethylolcyclohexane or 1,12-dihydroxydodecane.

The acetals herein, when formed using polyols, can be cyclic or acyclic acetals derivatizing one or more aldehydes. In general, alcohols can be saturated, unsaturated, linear or branched, alkyl, alkenyl, alkylaryl, alkylalkoxylate derivatives with one or more alcohol groups. The alcohols may contain additional functionality such as amines, amides, ethers, or esters as a part of their structure.

In more detail, the acetals herein derived from polyols can be cyclic or acyclic, and may contain one or more acetal groups through derivatizing one or more aldehydes. The terms cyclic and acyclic in this context refer to the presence or absence of a covalent bond connecting moieties X and Y of the acetal. In cyclic acetals, X and Y as shown in general structure (I) below are typically connected to form a ring comprising 2 or more carbons ($n \geqq 2$). Certain cyclic acetals can be connected by two carbons to form a five-membered dioxolane ring, as shown in (II), or three carbons can be connected, to form a six-membered dioxane ring, as shown in (III); larger cyolic acetals are also known.

I

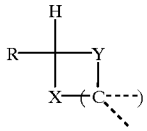

II

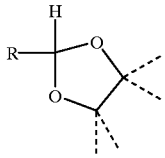

III

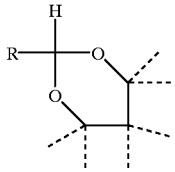

The laundry compositions of the present invention encompass many acetals termed "acyclic" because moieties X and Y are not covalently bonded to form an acetal of ring-type. Such acyclic acetals may in general nonetheless contain one or more cyclic moieties in any of R, X and Y. Many pro-fragrant acetals especially preferred for liquid detergent compositions herein are acyclic. For heavy duty liquid laundry (HDL) detergent compositions, a preferred class of pro-frgrant acetals are the acyclic dialkyl acetals derived from fragrant aldehydes that are aliphatic in structure. These acetals exhibit improved stability in conventional HDL formulations.

For heavy-duty granular detergent (HDG) compositions, a preferred class of acetals is the acyclic dialkyl acetals derived from fragrance aldehydes. Such acetals that are allylic or benzylic in structure are more preferred. These materials more readily hydrolyze delivering bigger odor benefits at lower levels.

Specific preferred pro-fragrant acetal compounds are non-limitingly illustrated by the following: digeranyl citral acetal; di(dodecyl) citral acetal; digeranyl vanillin acetal; didecyl hexyl cinnamaldehyde acetal; didecyl ethyl citral acetal; di(dodecyl) ethyl citral; didecyl anisaldehyde acetal; di(phenylethyl) ethyl vanillin acetal; digeranyl p-t-bucinal acetal; didecyl triplal acetal; di(dodecyl) triplal metal; digeranyl decanal acetal; di(dodecyl) decanal acetal; dicitronellyl laural acetal; di(tetradecyl) laural acetal; di(octadecyl)

belional acetal; di(phenylethyl) citronellal acetal; di(3-methyl-5-phenyl pentanol) citronellal acetal; di(phenylhexyl) isocitral acetal; di(phenylethyl) floralozone acetal; di(2-ethylhexyl) octanal acetal; di(9-decenyl)p-t-bucinal acetal; di(cis-3-hexenyl) methyl nonyl acetaldehyde acetal and di(phenylethyl) p-t bucinal acetal.

Other pro-fragrant acetals included in preferred embodiments of the present invention are:

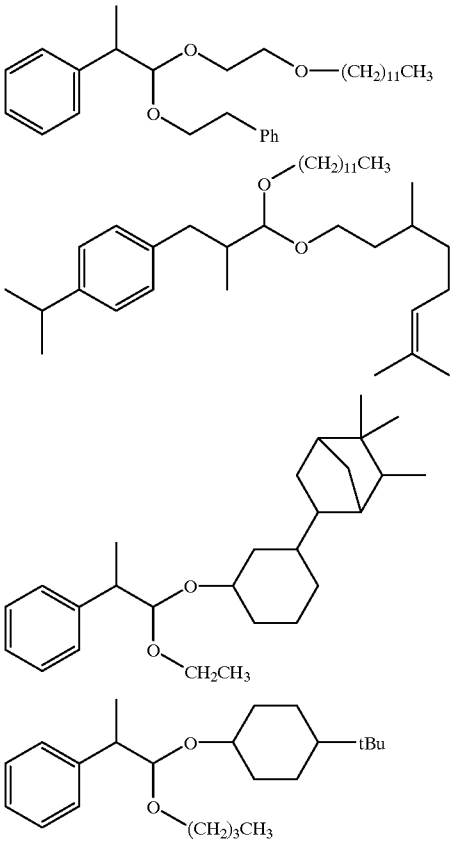

The above pro-fragrant acetals illustrate incorporation of structural features such as inclusion of fatty (i.e., detergent) alcohols and fatty alcohol ethoxylates into the pro-fragrant acetal; as well as the formation of pro-fragrant mixed acetals.

Moreover other desirable acetals herein include: acetal of p-t-bucinal and ISOFOL or other branched detergent alcohols (Condea); acetal of triplal and two moles of $CH_3(CH_2)_{11}OC(O)CH_2OH$; acetal of floralozone and two moles of Neodol 1–3 detergent alcohol obtainble from Shell; diacetal of ethylvanillin and pentaerythritol; acetal of lauryl aldehyde and two moles of 2-ethylhexanol.

Additionally, suitable acetals herein are cyclic acetals derived from the reaction of fragrance aldehydes with poylhydroxyglucosides, including the polyhydroxyamides. Typical examples of suitable polyhydroxy amides include the $C_{12}$–$C_{18}$ N-methylglucamides. See WO 9,206,154. Other sugar-derived acetal or ketal parent compounds herein include the N-alkoxy polyhydroxy fatty acid amides, such as $C_{10}$–$C_{18}$ N-(3-methoxypropyl) glucamide.

More generally, suitable ketals herein can be constructed using structural principles analogous to those used in discussing acetals supra. More particularly, suitable ketals have the following structure:

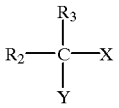

Ketals can be used to deliver fragrance ketones, fragrance alcohols, or both. $R_2$ and $R_3$ are derived from the parent ketone, and can be the same or different, and X and Y are derived from alcohols. Provided that at least one fragrant ketone is incorporated into the ketal, the alcohols incorporated need not be fragrant; reciprocally, when at least one fragrant alcohol is incorporated, the ketones may be non-fragrant. In the case of incorporation of non-fragrant ketone, it is preferred that in sum, $R_2$+$R_3$ contain eight or more carbons. In addition, the non-fragrant ketone can contain one or more ketone fimctional groups and such groups can be further derivatized so that the ketal is polymeric. While polyketals are included herein, they are less preferred than mono- and di-ketals. Monoketals are most preferred.

Exemplary diketals are shown below:

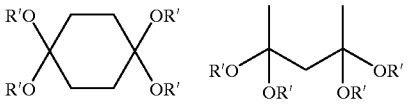

where R'O is derived from a perfume alcohol

In general, both fragrant and non-fragrant ketones can be aliphatic, allylic or benzylic. The ketones can be saturated, unsaturated, linear, branched, or cyclic. $R_2$ and $R_3$ can include alkyl, alkenyl, or aryl moieties as well as other functional groups including amides, amines, ethers, or esters.

As noted in defining the acetals supra, X and Y for ketals are alkoxy groups derived from alcohols that can be either fragrant alcohols or non-fragrant alcohols. X and Y can be the same or different, allowing the delivery of more than one type of fragrant alcohol. As in the case of acetals defined supra, suitable parent alcohols for ketals include $C_6$–$C_{20}$ (preferably $C_{11-C20}$) alcohols such as fatty alcohols and their etboxylated, propoxylated and butoxylated derivatives. It is preferred in the present ketals to incorporate alcohols that are fatty alcohols. Suitable ketals derived from polyols can be cyclic or acylic ketals, derivatizing one or more ketones. In general, alcohols can be saturated, unsaturated, linear or branched, alkyl, alkenyl, alkylaryl, alkylakoxylate derivatives with one or more alcohol groups. The alcohols may contain additional functionality such as amines, amnides, ethers, or esters as a part of their structure. X and Y can be simple alcohols containing a single OH group or polyols containing 2 or more OH groups.

Specific preferred pro-fragrant ketal compounds are non-limitingly illustrated by the following: ditphenyl ethyl) alpha ionone ketal; di(dodecyl) alpha ionone ketal; di(phenyl hexyl) beta ionone ketal; di(citronellyl) gamma methyl ionone ketal; di(tetradecyl) gamma methyl ionone ketal; didecyl methyl beta naphthyl ketal; dioctadecyl cis jasmone ketal; digeranyl damascenone ketal; di(cis-3-hexenyl) methyl dihydrojasmonate ketal; di(dodecyl) methyl dihydrojasmonate ketal; didecyl benzyl acetone ketal; di(2-ethylhexyl) methyl amyl ketal; di(dodecyloxyethyl) methyl amyl ketal; di(octadecyl) carvone ketal; and digeranyl geranyl acetone ketal.

For heavy duty granular detergent compositions or heavy duty liquid detergents, the preferred ketals include cyclic and acyclic aliphatic ketals. More preferred are acyclic aliphatic ketals.

Other specific ketals useful herein include:

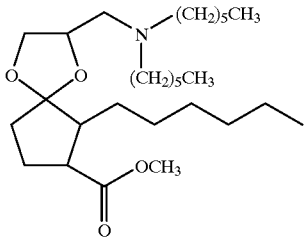

is derived from methyl dihydrojasmonate and a dialkylaminopropanediol of the indicated chainlength.

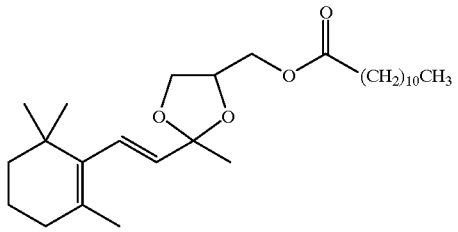

is a ketal of beta-ionone and a glyceryl fatty monoester having the indicated chainlength.

Variations of the present invention include laundry detergents which incorporate acetals or ketals wherein the parent alcohol is a polymer such as polyvinyl alcohol, starch or synthetic copolymers incorporating tri or polyhydric alcohols as monomers.

The essential pro-fragrance component herein can be used at widely ranging levels. Thus, a pro-fragrent acetal, ketal or mixture thereof is formulated in the present detergent compositions at levels in the general range about 0.0001% to about 10%, more preferably from about 0.001% to 5%, more preferably still, from about 0.01% to about 1%.

A pro-fragrance can be used as the sole fragrance component of the present detergent compositions, or in combination with other pro-fragrances and/or in combination with other fragrance materials, extenders, fixatives, diluents and the like. For example, incorporation of the pro-fragrant material into a waxy substance, such as a fatty triglyceride may further improve storage stability of the present pro-fragrant compounds in granular laundry detergents, especially those comprising bleach. In liquid or gel forms of detergent compositions, hydrophobic liquid extenders, diluents or fixatives can be used to form an emulsion wherein the pro-fragrant compound is further stabilized by separating it from the aqueous phase. Nonlimiting examples of such stabilizing materials include dipropylene glycol, diethyl phthalate and acetyl triethyl citrate. Just as there exist hydrophobic perfumery ingredients which can be used to stabilize the pro-fragrant material, there also exist detergency ingredients which also have a perfume stabilizing effect and can be formulated with the pro-fragrant material. Such ingredients include fatty acid amines, low foaming waxy nonionic materials commonly used in automatic dishwashing detergents, and the like. In general where pro-fragrances are used along with other fragrance materials in detergent compositions herein it is preferred that the pro-fragrance be added separately from the other fragrance materials.

Synthesis of Pro-fragrances

Acetals and ketals can be prepared by the acid catalyzed reaction of an aldehyde or ketone with an alcohol (or diol), using conventional acid catalysis such as HCl or p-toluenesulfonic acid, or supported sulfonic acid catalysts e.g., AMBERLYST 15™. See Meskens, F., *Synthesis*, (7) 501 (1981) and Meskens, F., *Jannsen Chim Acta* (1) 10 (1983). Many aldehyde, ketone and alcohols useful in the synthesis of acetal and ketal pro-fragrances of the present invention are sensitive to strong acid conditions and can undergo undesirable side reactions. See Bunton, C. A. et al, *J. Org. Chem.* (44), 3238, (1978), and Cort, O., et al, *J. Org. Chem.* (51), 1310 (1986). It is also known that acetals of alpha, beta unsaturated aldehydes can undergo migration of the double bond under the inappropriate selection of the acid catalyst. See Meskens, F., *Synthesis*, (7), 501, (1981) and Lu, T.-J, et al. *J. Org. Chem.* (60), 2931, (1995). For acid sensitive materials, acid catalysts with pKa's between 3 and 4 are the most desirable to minimize double bond migration while maintaining the reactivity necessary to produce the acetal (or ketal). For example, in the synthesis of digeranyl decanal, p-toluenesulfonic acid ($pK_a$=1) causes undesirable side reactions with geraniol. Citric acid ($pK_{a1}$=3.1, $pK_{a2}$=4.8, $pK_{a3}$=6.4) can be used to form the acetal without side reactions.

Another technique of avoiding side reactions in preparing acetals and ketals of acid sensitive materials, such as geraniol, is by transacetalization of a dimethyl acetal or ketal with a higher molecular weight alcohol, using a mild Lewis acid such as titanium isopropoxide or boron trifluoride etherate as the catalyst.

Novel Pro-fragrance Compounds

The present invention also includes novel pro-fragrance compounds. These can be broadly described as being selected from the group consisting of pro-fragrant acetals, and ketals wherein at least one of the parent aldehydes, ketones, or alcohols of said pro-fragrant acetal or ketal is a fragrance compound, said pro-fragrant compound having:

(i) a molecular weight of at least about 350, (ii) a CLogP of at least about 4 (preferably at least about 6, most preferably at least about 10), wherein CLogP is the logarithm to base 10 of the Octanol/Water Partition Coefficient of said pro-fragrant compound, and (iii) a half-life of less than 60 minutes, when measured at pH 0 by the Pro-Fragrant Hydrolysis Test;

provided that said parent aldehyde, ketone or alcohol of said acetal or ketal comprises at least one compound selected from the group consisting of a) aldehydes, ketones and alcohols containing at least one aromatic moiety selected from the group consisting of $C_6H_4$ and $C_6H_3$ and wherein said parent aldehyde or ketone has a molecular weight of at least 125, preferably at least 140;

b) monoalcohols selected from $C_{11}$–$C_{20}$ saturated, unsaturated, aromatic or aliphatic, linear and branch chain alcohols and alkoxylates of said alcohols containing from 1 to about 30 alkoxy groups wherein the alkoxy groups are selected from ethoxy, propoxy butoxy and mixtures thereof;

c) polyhydroxy alcohols, and d) mixtures thereof.

Examples of parent aldehydes for these novel compounds are:

Hexyl cinnamaldehyde, p-t-bucinal, Floralozone, cymal, phenylpropanal, anisaldehyde, vanillin, ethyl vanillin, citral, ethyl citral, citronellal, hydroxycitronellal, methyl octyl acetaldehyde, methyl nonyl acetaldehyde, octanal, decanal, lauric aldehyde, chrysanthal, Triplal, helional, isocyclocitral, melonal, trans-4-decenal, adoxal, iso-hexenyl cyclohexenyl carboxaldehyde.

Examples of parent ketones for these novel compounds are:

benzyl acetone, alpha-ionone, beta-ionone, gamma-methyl ionone, irone alpha, methyl dihydrojasmonate, cis-jasmone, methyl amyl ketone, methyl heptyl ketone, methyl hexyl ketone, methyl nonyl ketone, carvone, damascenone, alpha damascone, methyl beta-napthyl ketone, cassione, menthone.

Examples of monohydric alcohols for these novel compounds are:

Hexanol, 2-ethyl hexanol, octanol, decanol, dodecanol, octadecanol, phenyl ethanol, phenyl hexanol, 9-decenol, isolauryl alcohol, oleyl alcohol, 2-methyl undecanol, decanol with 3 moles propylene oxide and 3 moles ethylene oxide, dodecanol with 4 moles butylene oxide and 5 moles ethylene oxide, methanol with 2 moles of propylene oxide, N,N-dihexyl aminopropanol, N,N-dimethylaminoethoxyethanol.

Additional examples include the use of monohydric alcohols such as those exemplified by Cellosolve(™) Carbito(™), Propasol(™) (Union Carbide), and Neodol(™) linear alkyl alkoxylates (Shell), Tergitol TMN(™) and 15-S(™) branched alkyl ethoxylates (Union Carbide), and Plurafac(™) modified alkyl ethoxylates (BASF).

Examples of polyhydric alcohols are glycerol, mannitol, sorbitol and glucose, as well as substituted polyhydric alcohols such as glycerol laurate, glycerol monooleate, sorbitan laurate, sorbitan oleate, sucrose dioleate, N-dodecyl glucosamine and dodecyl glucose. Additional examples include $C_{10}$–$C_{18}$ N-alkyl polyhydroxy fatty acid amides. See WO 9,206,154.

Test Methods

Calculation of CLogP

The pro-fragrances of the invention are characterized by their octanol/water partition coefficient P. The octanol/water partition coefficient of a pro-fragrance is the ratio between its equilibrium concentration in octanol and in water. Since the partition coefficients of the pro-fragrance compounds are large, they are more conveniently given in the form of their logarithm to the base 10, logP.

The logP of many compounds have been reported; for example, the Pomona92 database, available from Daylight Chemical Information Systems, Inc. (Daylight CIS), contains mnany, along with citations to the original literature.

However, the logP values are most conveniently calculated by the "CLOGP" program, also available from Daylight CIS. This program also lists experimental logP values when they are available in the Pomona92 database. The "calculated logp" (CLogP) is determined by the fragment approach of Hansch and Leo (cf., A. Leo, in Comprehensive Medicinal Chemistry, Vol. 4, C. Hansch, P. G. Sammens, J. B. Taylor and C. A. Ramnsden, Eds., p. 295, Pergamon Press, 1990). The fragment approach is based on the chemical structure of a compound and takes into account the numbers and type of atoms, the atom connectivity, and chemical bonding. The CLogP values, which are the most reliable and widely used estimates for this physicochemical property, can be used instead of the experimental logP values in the selection of pro-fragrances.

Determination of Hydrolysis Half-life (t-½)

Hydrolysis half-life is the measurement used to determine the ease with which the pro-fragrance compound undergoes acid hydrolysis and thereby releases its fragrance component (s) upon exposure to acid conditions. The pro-fragrant compounds of the invention have a half-life of less than 60 minutes, under the described hydrolysis conditions at pH 0. Preferably, pro-fragrances of the invention have a half-life at pH 2 of less than 60 minutes. For granular detergents, the more reactive pro-fragrances, that is, those with half-life at pH 2 of less than one minute, are most suitable, although those having a half-life of less than 60 minutes at pH 0 are also useful. For liquid detergent applications, pro-fragrances having a half-life of less than 60 minutes at pH 0, and half-life greater than one minute at pH 2 should preferably be used.

Hydrolysis half-life is determined by UV/V is spectroscopy in a 90/10 dioxane/water system at 30° C. by following the appearance of the carbonyl absorbance. Because of the hydrophobicity of the pro-fragrance compounds of the invention, a high dioxane/water ratio is needed to ensure solubility of the pro-fragrance. The pH of the water used is achieved by using aqueous HCl. The concentration of the pro-fragrance in the dioxane/water system can be adjusted to achieve convenient, measurable absorbance changes.

All measurements are carried out using a Hewlett Packard 8452 A Diode Array Spectrophotometer using quartz 1 cm path length cuvette cells. Materials used include 1,4-dioxane HPLC Grade 99.9% (Sigma-Aldrich), 1N HCl volumetric solution (J. T. Baker), deionized water filtered with MilliQ-Plus (Millipore) at resistivity of 18.2 M Ohm cm. The pH's are measured using an Orion 230 A standardized with pH 4 and pH 7 buffers. The 1N HCl standard is used directly for pH 0 conditions. For pH 2 conditions, 1N HCl is diluted with deionized water.

Pro-fragrance is weighed out in a 10.00 ml volumetric flask using an analytical balance (Mettler AE 200) Precision is 1/10 mg. The weighed material is dissolved in about 8 ml dioxane. Both the dioxane solution of pro-fragrance and aqueous acid solution prepared as described supra are preheated in their separate containers to a temperature of 30±0.25° C. by means of a water-bath. 1.000 ml of aqueous acid solution is added to the pro-fragrance solution by means of an Eppendorf pipetter. This is followed by diluting to the 10.00 ml mark with dioxane. Hydrolysis time is measured, starting upon addition of the acid. The pro-fragrance solution is mixed for 30 seconds by shaking, and the solution is transferred to a quartz cuvette. The absorbance of the pro-fragrance solution ($A_t$) is followed at a regular series of time intervals, and the cuvette is kept in the water-bath at the above-indicated temperature between measurements. Initial absorbance ($A_o$) measurements are carried out using an equal concentration of pro-fragrance in a 90/10 v/v dioxane-deionized water solution, and final absorbance ($A_f$) measurements are taken using the hydrolyzed pro-fragrance solution after the hydrolysis is complete. The wavelength at which the hydrolysis is followed is chosen at the wavelength of the absorbance maximum of the parent aldehyde or ketone.

Reaction half-lifes are determined using conventional procedures. The observed first-order rate constant ($k_{obs}$) is determined by slope of the line provided by plotting the following finction vs time (min):

$$\mathrm{Ln}[(A_o-A_f)/(A_t-A_f)]$$

wherein said function is the natural log of the ratio between the absorbance difference at initial time ($A_o$) and final time ($A_f$) over the absorbance difference at time t ($A_t$) and final time ($A_f$).

Half-life as defined herein is the time required for half of the pro-fragrance to be hydrolyzed, and is determined from the observed rate constant ($k_{obs}$) by the following function:

$$\mathrm{Ln}(½)=-k_{obs}t½$$

Conventional Detergent Ingredients

In addition to the pro-fragrance compound(s), the compositions herein include a detersive surfactant and optionally, one or more additional detergent ingredients, including materials for assisting or enhancing cleaning performance, treatment of the substrate to be cleaned, or to modify the aesthetics of the detergent composition (e.g., perfumes, colorants, dyes, etc.). The following are illustrative examples of detersive surfactants and other detergent ingredients.

Detersive Surfactants Non-limiting examples of synthetic detersive surfactants useful herein typically at levels from about 0.5% to about 90%, by weight, include the conventional $C_{11}$–$C_{18}$ alkyl benzene sulfonates ("LAS") and primary, branche-chain and random $C_{10}$–$C_{20}$ alkyl sulfates ("AS"), the $C_{10}$–$C_{18}$ secondary (2,3) alkyl sulfates of the formula $CH_3(CH_2)_x(CH(CH_3)OSO_3^-M^+)$ and $CH_3\ (CH_2)_y(CH(CH_2CH_3)OSO_3^-M^+)$ wherein x and y are integers and wherein each of x and (y+1) is least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxylates), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used, however synthetic detergents are preferred. If high sudsing is desired, the branched-chain $C_{10}$–$C_{16}$ soaps may be used. Mixtures of anionic and nonionic surfactants are especially useful. Other conventional useful surfactants are listed in standard texts. See also U.S. Pat. No. 3,664,961, Norris, issued May 23, 1972.

Preferred compositions incorporating only synthetic detergents have a detergent level of from about 0.5% to 50%. Compositions containing soap preferably comprise from about 10% to about 90% soap.

Although the detergent compositions herein can consist of only detersive surfactant and pro-fragrance, the said compositions preferably contain other ingredients commonly used in detergent products.

Builders—Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or detergent builders include, but are not limited to phosphate builders such as, the alkali metal, ammonium and allanolammonium salts of polyphosphates (exemplified by the tripolyphosphates, pyrophosphates, and glassy polymeric meta-phosphates), phosphonates, and phytic acid, and non-phosphorous builders such as silicates, carbonates (including bicarbonates and sesquicarbonates), sulphates, and aluminosilicates. Non-phosphate builders are required in some locales.

Organic builders suitable for use herein include polycarboxylate builders such as disclosed in U.S. Pat. No. 3,308,067, Diehl issued Mar. 7, 1967; U.S. Pat. No. 4,144,226, Crutchfield issued Mar. 13, 1979 and U.S. Pat. No. 4,246,495, Crutchfield, issued Mar. 27, 1979.

Soil Release Agents

Soil Release agents are desirably used in laundry detergents of the instant invention. Suitable soil release agents include those of U.S. Pat. No. 4,968,451, Nov. 6, 1990 to J. J. Scheibel and E. P. Gosselink: such ester oligomers can be prepared by (a) ethoxylating allyl alcohol, (b) reacting the product of (a) with dimethyl terephthalate ("DMT") and 1,2-propylene glycol ("PG") in a two-stage transesterification/oligomerization procedure and (c) reacting the product of (b) with sodium metabisulfite in water; the nonionic end-capped 1,2-propylene/polyoxyethylene terephthalate polyesters of U.S. Pat. No. 4,711,730, Dec. 8, 1987 to Gosselink et al, for example those produced by transesterification/oligomerization of poly(ethyleneglycol) methyl ether, DMT, PG and poly(ethyleneglycol) ("PEG"); the partly- and fully-anionic-end-apped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al, the latter being typical of SRA's useful in both laundry and fabric conditioning products, an example being an ester composition made from m-sulfobenzcic acid monosodium salt, PG and DMT optionally but preferably further comprising added PEG, e.g., PEG 3400. Another preferred soil release agent is a sulfonated end-capped type described in U.S. Pat. No. 5,415,807.

Other Optional Ingredients

The compositions herein can contain other ingredients such as enzymes, bleaches, fabric softening agents, dye transfer inhibitors, suds suppressors, and chelating agents, all well known within the art.

For purposes of defmwing detergent compositions of the present invention, the pH of the detergent composition is that which is measured at 1% concentration of the detergent composition in distilled-water at 20° C. The detergent compositions herein have a pH of from about 7.1 to about 13, more typically from about 7.5 to about 9.5 for liquid detergents and from about 8 to about 12 for granular detergents.

Formulation with Detergents With or Without Conventional Perfumery Materials

While the pro-fragrances of the present invention can be used alone and simply mixed with essential detergent ingredient, most notably surfactant, they can also be desirably combined into three-part formulations which combine (a) a non-fragranced detergent base comprising one or more synthetic detergents, (b) one or more pro-fragrant acetals or ketals in accordance with the invention and (c) a fully-formulated fragrance. The latter provides desirable in-package and in-use (wash-time) fragrance, while the pro-fragrance provides a long-term fragrance to the laundered textile fabrics.

In formulating the present detergents, the fully-formulated fragrance can be prepared using numerous known odorant ingredients of natural or synthetic origin. The range of the natural raw substances can embrace not only readily-volatile, but also moderately-volatile and slightly-volatile components and that of the synthetics can include representatives from practically all classes of fragrant substances, as will be evident from the following illustrative compilation: natural products, such as tree moss absolute, basil oil, citrus fruit oils (such as bergamot oil, mandarin oil, etc.), mastix absolute, myrtle oil, palmarosa oil, patchouli oil, petitgrain oil Paraguay, wormwood oil, alcohols, such as farnesol, geraniol, linalool, nerol, phenylethyl alcohol, rhodinol, cinnamic alcohol, aldehydes, such as citral, Helional™, alpha-hexyl-cinnamaldehyde, hydroxycitronellal, Lilial™ (p-tert.butyl-alpha-methyldihydrocinnamaldehyde), methylaonylacetaldehyde, ketones, such as allylionone, alpha-ionone, beta-ionone, isoraldein (isomethyl-alpha-ionone), methylionone, esters, such as allyl phenoxyacetate, benzyl salicylate, cinnamyl propionate, citronellyl acetate, citronellyl ethoxolate, decyl acetate, dimethylbenzylcarbinyl acetate, dimethylbenzylcarbinyl butyrate, ethyl acetoacetate, ethyl acetylacetate, hexenyl isobutyrate, linalyl acetate, methyl dihydrojasmonate, styrallyl acetate, vetiveryl acetate, etc., lactones, such as gamma-undecalactone, various components often used in perfumery, such as musk ketone, indole, p-menthane-8-thiol-3-one, and methyl-eugenol. Likewise, any conventional fragrant acetal or ketal known in the art can be added to the present composition as an optional component of the conventionally formulated perfume (c). Such conventional fragrant acetals and ketals include the well-known methyl and ethyl acetals and ketals, as well as acetals or ketals based on benzaldehyde, those comprising phenylethyl moieties, or more recently developed specialties such as those described in a United States Patent entitled "Acetals and Ketals of Oxo-Tetralins and Oxo-Indanes, see U.S. Pat. No. 5 ,084,440, issued Jan. 28, 1992, assigned to Givaudan Corp. Of course, other recent synthetic specialties can be included in the perfume compositions for fully-formulated detergents. These include the enol ethers of alkyl-substituted oxo-tetralins and oxo-indanes as described in U.S. Pat. No. 5,332,725, Jul. 26, 1994, assigned to Givaudan; or Schiff Bases as described in U.S. Pat. No. 5,264,615, Dec. 9, 1991, assigned to Givaudan. It is preferred that the pro-fragrant material be added separately from the conventional fragrances to the detergent compositions of the invention.

Formulation with other Special-Purpose Fragrance Delivering Compounds

Detergents in accordance with the present invention may further, optionally, if desired, contain other known compounds having the capability to enhance substantivity of a fragrance. Such compounds include, but are not limited to, the aluminium alkoxides such as isobutylaluminium diferanylate as disclosed in U.S. Pat. No. 4,055,634, issued Oct. 25, 1977 and assigned to Hoffman-La Roch; or the known titanate and zirconate esters or oligoesters of fragrant materials such as those disclosed in U.S. Pat. No. 3,947,574, Jaggers et al, issued Mar. 30, 1976 and U.S. Pat. No. 3,779,932, Jaggers, issued Dec. 18, 1973. When using such organoaluminium, organotitanium or organozinc derivatives, they may be incorporated into the present formulations at their art-known levels.

Methods of Use

In its method aspect, the present invention can be described as:

A method of delivering residual fragrance to a washed surface which comprises the steps of (a) washing said surface in an aqueous solution of a detergent composition comprising
  (i) a pro-fragrant compound selected from the group consisting of acetals, ketals, and mixtures thereof, said pro-fragrant compound having;
    (1) a molecular weight of at least about 350,
    (2) a CLogP of at least about 4, wherein CLogP is the logarithm to base 10 of the octanol/water partition coefficient of said pro-fragrant compound, and
    (3) a half-life of less than 60 minutes, when measured at pH 0 by the Pro-Fragrant Hydrolysis Test; and
  (ii) a detersive surfactant; wherein said detergent composition has a pH of at least 7.1 when measured as a 1% solution in distilled-water at 20° C.;

(b) subsequently exposing said surface to a reduction in pH.

EXAMPLES

Example 1

Preparation of Didecyl Anisaldehyde Acetal by Acid Catalysis

In a 500 ml single necked round bottom flask assembled with a Dean-Stark trap and condenser under a nitrogen atmosphere, anisaldehyde (21.3 g, 0.156 mol), decanol (98.8 g, 0.627 mol, 4 eq.), and para toluene sulfonic acid (0.30 g, 1 mol %) are dissolved in 150 ml toluene and brought to reflux until starting aldehyde is completely consumed. Upon cooling, the reaction mixture is washed three times with saturated sodium carbonate followed by drying with anhydrous magnesium sulfate. The solvent is removed under reduced pressure, and unreacted parent compounds are removed under bulb-to-bulb distillation at 60–80° C., 0.4 mm Hg, yielding 48.1 g of a brown oil (71%). The acetal is then further purified by column chromatography on 230–400 mesh 60 A silica gel eluting with 4% ethyl acetate/1% triethylamine/petroleum ether yielding a yellow oil (43.2 g, 64% yield). $t_{1/2}$ at pH 0 is less than 1 minute. CLogP is 11.09.

Example 2

Preparation of Digeranyl Citral Acetal Using Transacetalization

In a 500 ml single necked round bottom flask assembled with a short path distillation apparatus under a nitrogen atmosphere, citral dimethyl acetal (41.0 g, 0.21 mol), geraniol (100 g, 0.65 mol, 3.2 eq.) and titanium isopropoxide (3.0 g, 5 mol %) are dissolved in 200 ml of toluene and brought to reflux. Toluene is distilled off as a means to azeotropically remove methanol from the reaction mixture. Six 150 ml portions of toluene are added to the reaction mixture and distilled off over the course of 10 hours until TLC shows the reaction is complete. The remaining toluene is removed under reduced pressure, and unreacted parent compounds are removed by bulb-to-bulb distillation at 65–85° C., 0.4 mm Hg, yielding a yellow-brown oil. The product is then further purified by column chromatography on 230–400 mesh 60 A silica gel eluting with 2% ethyl acetate/1% triethylamine/petroleum ether yielding a yellow oil (59 g, 67% yield). $t_{1/2}$ at 0 pH is less than one minute. CLogP is 9.75.

Example 3

Preparation of the Didecyl Benzyl Acetone Ketal by Acid Catalysis

In a 500 ml single necked round bottom flask assembled with a Dean-Stark trap and condenser under a nitrogen atmosphere, benzyl acetone (13.1 g, 0.088 mol), decanol (51.7 g, 0.33 mol), and para-toluene sulfonic acid are dissolved in 100 ml toluene and brought to reflux. After 24 hours, the water is removed from the Dean-Stark trap, and the trap is filled with 3 A activated molecular sieves (J. T. Baker). The reaction mixture is refluxed for an additional 24 hours. After cooling, the reaction mixture is washed three times with saturated sodium carbonate and dried over anhydrous magnesium sulfate. The toluene is removed under reduced pressure followed by removal of unreacted parent compounds by bulb-to-bulb distillation at 65–85° C., 0.4 mm Hg yielding a yellow oil (15.8 g, 38% yield). $t_{1/2}$ at 0 pH is less than one minute. CLogP is 11.65.

Example 4

Preparation of the Digeranyl Decanal Acetal by Acid Catalysis In a 1 L single necked round bottom flask assembled with a Dean-Stark trap and condenser under a nitrogen atmosphere, decanal (50 g. 32 mol.), geraniol (197.4 g, 1.28 mol, 4 eq.) and anhydrous citric acid (6.14 g, 0.032 mol) are dissolved in 320 ml toluene and refluxed for 24 hours. Upon cooling, the reaction mixture is washed three times with saturated sodium carbonate followed by drying over magnesium sulfate. The solvent is removed under reduced pressure, and excess geraniol is removed under bulb-bulb distillation at 60–80° C., 0.1 mm Hg, giving a clear yellow oil (132.1 g, 92% yield). $t_{1/2}$ at 0 pH is 44 minutes. CLogP is 11.66.

Example 5

| Granular Laundry Composition delivering Geraniol from Digeranyl Citral Acetal | |
|---|---|
| Pro-fragrance of Example 2 | 1.0% |
| C11–C13 Dodecyl Benzene Sulfonate | 21.0% |
| C12–C13 Alkyl Ethoxylate EO 1-8 | 1.2% |
| Sodium Tripolyphosphate | 35.0% |
| Zeolite Na 4A | 14.0% |
| Sodium Silicate 2.0 ratio | 2.0% |
| Sodium Carbonate | 23.4% |
| Enzyme (Savinase ™ and/or Lipolase ™ from Novo) | 1.4% |
| Carboxymethyl Cellulose | 0.3% |
| Anionic Soil Release Agent * | 0.3% |
| Brightener | 0.2% |
| Silicone Suds Suppressor ** | 0.2% |
| Perfume *** | 0.3% |
| Sodium Sulfate | 0.5% |
| Moisture | balance |

* See U.S. Pat. No. 4,968,451
** Commercial material available from Dow Corning Corp.
*** Perfume composition of the following formula:

| | |
|---|---|
| Benzyl salicylate | 20% |
| Elhylene brassylate | 20% |
| Galaxolide (50% soln. in benzyl benzoate) | 20% |
| Hexyl cinnamic aldehyde | 20% |
| Tetrahydro linalool | 20% |
| | 100% |

-continued

| Granular Laundry Composition delivering Geraniol from Digeranyl Citral Acetal | |
|---|---|

Example 6

| Granular Laundry Detergent Delivering Anisaldehyde from Didecyl Anisaldehyde Acetal | |
|---|---|
| Pro-fragrance of Example 1 | 1.0% |
| Linear Dodecyl Benzene Sulfonate | 21.0% |
| Neodol 23-6.5 - Nonionic Surfactant | 1.2% |
| Sodium Tripolyphosphate | 35.0% |
| Zeolite 4A | 14.0% |
| Sodium Silicate 2.0 ratio | 2.0% |
| Sodium Carbonate | 23.4% |
| Enzyme (Savinase ™ and/or Lipolase ™ from Novo) | 1.5% |
| Carboxymethyl Cellulose | 0.3% |
| Anionic Soil Release Agent* | 0.3% |
| Brightener | 0.2% |
| Silicone Suds Suppressor** (See footnote in Ex. 5) | 0.2% |
| Perfume*** (See footnote in Example 5) | 0.3% |
| Sodium Sulfate | 0.5% |
| Moisture | balance |

* See U.S. Pat. No. 4,968,451

Example 7

Laundry Detergent Comprising Pro-Fragrance and Fully-Formulated Perfume Composition having a Conventional Ketal fragrance Component A laundry detergent composition is prepared by weighing 98 grams of laundry detergent according to Example 6 with the exception that perfume and pro-fragrance are not inculded; admixing to said composition 2 grams of a perfume of flowery-woody type made up of a mixture of a first premix and a conventional ketal (not in accordance with essential pro-fragrance as defined herein) as follows:

| First Premix: | |
|---|---|
| Oil of bergamot | 7.5 |
| Linalool | 4.0 |
| Phenyl ethyl alcohol | 4.0 |
| Benzyl acetate | 2.0 |
| Citronellol | 0.5 |
| Hedione ™ (a) | 10.0 |
| Lyral ™ (b) | 4.0 |
| Hydroxycitronellal | 2.5 |
| Rose oxide 1 (c) 10% in DPG | 2.5 |
| Hexyl cinnamic aldehyde, alpha | 7.5 |
| Patchouly Oil Indonesian | 4.0 |
| Iso-E ™ (b) | 2.0 |
| Vetiveryl acetate | 2.0 |
| Brahmanol ™ F (c) | 2.0 |
| Benzyl Salicylate | 2.0 |
| cis-3-Hexenyl Salicylate | 1.0 |
| Cedramber ™ (b) | 1.0 |
| Musk Xylene | 1.0 |
| Indole 10% in DPG | 0.5 |
| Extract of Opoponax | 0.5 |

-continued

| First Premix: | |
|---|---|
| Extract of Oakmoss 50% in DPG | 5.0 |
| (a) Firmenich | |
| (b) IFF | |
| (c) DRAGOCO | |
| Total Parts by weight of First Premix: | 68.0 |

The first perfume premix is modified by adding to it 32 parts by weight of 5a/5b (80:20) wherein 5a is 5-ethylenedioxy-3.beta.-H-isolongifolane and 5b is 5-ethylenedioxy-3. alpha.-H-isolongifolane; these two compounds being conventional perfume ketals not in accordance with the present invention, and their synthesis is described in "CYCLIC ISOLONGIFOLANONE-KETALS—THEIR MANUFACTURE AND THEIR APPLICATION", U.S. Pat. No. 5,426,095, issued Jun. 20, 1995 to Brunke and Schatkowski, assigned to Dragoco.

1.0 grams of a pro-fragrance according to Example 2 is mixed into the powdered, perfume-free detergent composition. Finally, about 1.5 grams of the above perfume composition is sprayed onto the mixture of detergent and pro-fragrance, to complete the fragranced, pro-fragranced laundry detergent composition. The said composition has a floral-woody character and leaves an improved, long-lasting scent on textile fabrics washed therewith.

Example 8

| Detergent having the form of a Laundry Bar Comprising Pro-Fragrance | |
|---|---|
| Pro Fragrance of Example 1 | 1.0% |
| Tallow Soap*** and Coco Soap Mixture (80:20) | 44.0% |
| Linear Dodecyl Benzene Sulfonate | 12.0% |
| Sodium Tripolyphosphate | 6.0% |
| Sodium Carbonate | 8.0% |
| Sodium Sulfate | 0.5% |
| Talc | 9.0% |
| Perfume*** | 0.2% |
| Moisture | balance |

*Iodine Value = 40
***See footnote in Example 5

Example 9

| Liquid Detergent Comprising Pro-Fragrance | |
|---|---|
| Pro Fragrance of Example 1 | 1.0% |
| Sodium C12–C15 Alcohol Ethoxylate E 2.5 Sulfate | 18.0% |
| Neodol 23-9 Nonionic surfactant | 2.0% |
| $C_{12}$ Alkyl N-Methylglucamide | 5.0% |
| Sodium Cumene Sulfonate | 3.0% |
| Citric Acid | 3.0% |
| Fatty Acid (C12–C14) | 2.0% |
| Boric Acid | 3.5% |
| Sodium Hydroxide | 2.8% |
| Ethoxylated Tetraethylene Pentaimine | 1.2% |
| Soil Release Polymer | 0.15% |
| 1,2-Propanediol | 8.0% |
| Ethanol | 3.6% |
| Monoethanolamine | 1.1% |
| Minors* | 1.80% |
| Water | Balance |

*Minors include brightner and enzymes

Although the examples illustrate the invention as described, those skilled in the art will be able to recognize that variations thereof are fully within the scope of the invention. In one such variation, the practioner will minimize the molecular weight while still seeking the advantages of the invention, for example by selecting pro-fragrances at –½ of less than one minute at pH 0.

What is claimed is:

1. A detergent composition for imparting residual fragrance to surfaces washed with aqueous solutions of said detergent, said detergent comprising:

(a) 0.001% to 5% of a pro-fragrant compound selected from the group consisting of digeranyl citral acetal, di(dodecyl) citral acetal, digeranyl vanillin acetal, didecyl hexyl cinnamaldehyde acetal, didecyl ethyl citral acetal, di(dodecyl) ethyl citral, didecyl anisaldehyde acetal, di(phenylethyl)ethyl vanillin acetal, digeranyl p-t bucinal acetal, didecyl triplal acetal, di(dodecyl) triplal acetal, digeranyl decanal acetal, di(dodecyl) decanal acetal, dicitronellyl laural acetal, di(tetradecyl) laural acetal, di(octadecyl) helional acetal, di(phenylethyl) citronellal acetal, di(3-methyl-5-phenyl pentanol) citronellal acetal, di(phenylhexyl) isocitral acetal, di(phenylethyl) Floralozone acetal, di(2-ethylhexyl) octanal acetal, di(9-decenyl)p-t-bucinal acetal, di(cis-3-hexenyl) methyl nonyl acetaldehyde acetal, di(phenylethyl) p-t-bucinal acetal, di(phenylethyl) alpha ionone ketal, di(dodecyl) alpha ionone ketal, di(phenylhexyl) beta ionone ketal, di(citronellyl) gamma methyl ionone ketal, di(tetradecyl) gamma methyl ionone ketal, didecyl methyl beta naphthyl ketal, dioctadecyl cis jasmone ketal, digeranyl damascenone ketal, di(cis-3-hexenyl) methyl dihydrojasmone ketal, di(dodecyl) methyl dihydrojasmonate ketal, didecyl benzyl acetone ketal, di(2-ethylhexyl) methyl amyl ketal, di(dodecyloxyethyl) methyl amyl ketal, di(octadecyl) carvone ketal, and digeranyl acetone ketal; and (b) 0.5% to 50% a detersive surfactant;

wherein said detergent composition has a pH of at least 7.1 when measured as a 1% solution in distilled-water at 20° C.

2. The composition of claim 1 wherein the composition is a granular detergent having a pH of from about 8 to about 12 and wherein the pro-fragrant compound has a half life of less than 1 minute when measured at pH 0.

3. The composition of claim 2 wherein the pro-fragrant compound has a half life of less than one minute when measured at pH 2.

4. The composition of claim 1 wherein the composition is a liquid detergent and wherein the pro-fragrant compound has a half life of less than 60 minutes when measured at pH 0 and a half life of greater than 1 minute when measured at pH 2.

5. A method of delivering residual fragrance to a washed surface comprising the steps of:

(a) washing said surface in an aqueous solution of a detergent composition comprising (i) 0.001% to 5% of a pro-fragrant compound selected from the group consisting of digeranyl citral acetal, di(dodecyl) citral acetal, digeranyl vanillin acetal, didecyl hexyl cinnamaldehyde acetal, didecyl ethyl citral acetal, di(dodecyl) ethyl citral, didecyl anisaldehyde acetal, di(phenylethyl)ethyl vanillin acetal, digeranyl p-t-bucinal acetal, didecyl triplal acetal, di(dodecyl) triplal acetal, digeranyl decanal acetal, di(dodecyl) decanal acetal, dicitronallyl laural acetal, di(tetradecyl) laural acetal, di(octadecyl) helional acetal, di(phenylethyl) citronellal acetal, di(3-methyl-5-phenyl pentanol) citronellal acetal, di(phenylhexyl) isocitral acetal, di(phenylethyl) Floralozone acetal, di(2-ethylhexyl) octanal acetal, di(9-decenyl)p-t-bucinal acetal, di(cis-3-hexenyl) methyl nonyl acetaldehyde acetal, di(phenylethyl p-t-bucinal acetal, di(phenylethyl) alpha ionone ketal, di(dodecyl) alpha ionone ketal, di(phenylhexyl) beta ionone ketal, di(citronellyl) gamma methyl ionone ketal, di(tetradecyl) gamma methyl ionone ketal, didecyl methyl beta naphthyl ketal, dioctadecyl cis jasmone ketal, digeranyl damascenone ketal, di(cis-3-hexenyl) methyl dihydrojasmone ketal, di(dodecyl) methyl dihydrojasmonate ketal, didecyl benzyl acetone ketal, di(2-ethylhexyl) methyl amyl ketal, di(dodecyloxyethyl) methyl amyl ketal, di(octadecyl) carvone ketal, and digeranyl acetone ketal; and (ii) a detersive surfactant; wherein said detergent composition has a pH of at least 7.1 when measured as a 1% solution in distilled-water; and (b) subsequently exposing said surface to a reduction in pH of at least 0.1 pH units.

6. The method of claim 5 wherein the pH in Step(b) is reduced by at least 0.5 units to a pH of 7.5 or less.

* * * * *

UNITED STATES PATENT AND TRADEMARK OFFICE

CERTIFICATE OF CORRECTION

PATENT NO. : 6,239,087 B1
DATED : May 29, 2001
INVENTOR(S) : Hsiang Kuen Mao et al.

It is certified that error appears in the above-identified patent and that said Letters Patent is hereby corrected as shown below:

Title page,
References Cited, U.S. PATENT DOCUMENTS,
"5,668,862 9/1997" should read -- 2,668,862 2/1954 --.

Column 22,
Line 4, after (ii) insert -- 0.5% to 50% of --.

Signed and Sealed this

Fifth Day of March, 2002

*Attest:*

*Attesting Officer*

JAMES E. ROGAN
*Director of the United States Patent and Trademark Office*